United States Patent [19]

Stanley

[11] 4,031,427

[45] June 21, 1977

[54] FLAT CATHODE RAY TUBE

[75] Inventor: Thomas Osborne Stanley, Princeton, N.J.

[73] Assignee: RCA Corporation, New York, N.Y.

[22] Filed: Aug. 25, 1975

[21] Appl. No.: 607,492

[52] U.S. Cl. ..... 313/422; 315/366

[51] Int. Cl.[2] ..... H01J 29/08; H01J 31/00

[58] Field of Search ..... 313/422, 411, 421; 315/366

[56] References Cited

UNITED STATES PATENTS

| | | | |
|---|---|---|---|
| 2,795,729 | 6/1957 | Gabor | 313/422 X |
| 2,858,464 | 10/1958 | Roberts | 313/422 |

*Primary Examiner*—Robert Segal

*Attorney, Agent, or Firm*—G. H. Bruestle; D. S. Cohen

[57] ABSTRACT

An evacuated envelope has a rectangular addressing section and a gun section at one edge of the addressing section. The addressing section includes front and back walls in closely spaced, parallel relation, and a plurality of spaced, parallel support walls between the front and back walls forming a plurality of parallel channels. The gun section extends across one end of the channels and includes gun structure which will selectively direct electrons along each of the channels. In each of the channels are guide means to confine the electrons in a beam which is spaced from the walls of the channel and guide the beam along the length of the channel. Deflection means are provided which permit selective deflection of the electron beams toward a target, e.g. a phosphor screen, which is disposed along the inner surface of the front wall.

9 Claims, 12 Drawing Figures

FLAT CATHODE RAY TUBE

BACKGROUND OF THE INVENTION

The present invention relates to a flat electron addressed device including apparatus for scanning electron beams over a target element thereof, and particularly to a structure for confining and guiding the beams and for selectively deflecting the beams toward the target.

There are various devices, such as optical display devices, information storage devices, scan converters, optical pick-up devices and the like, which include a target over which a beam of electrons is scanned to address the device. In an optical display device, such as a picture tube, the target is a phosphor screen. In an information storage device, the target may be a semiconductor storage element. In a scan converter and an optical pick-up device the target may be a photoconductor.

The electron beam addressed device of the present invention may be any device having a target over which a beam of electrons is scanned to address the target. For example, the device may be an information or storage device having a target of the type shown in U.S. Pat. No. 3,675,134 to E. Luedicke et al., issued July 4, 1972 entitled "Method of Operating an Information Storage Tube", or a scan converter having a target of the type shown in U.S. Pat. No. 3,182,223 to J. T. McNaney, issued May 4, 1965 entitled "Data Storage System With Light Beam Write/Readout", or an optical pick-up device having a target of the type shown in U.S. Pat. No. 2,967,254 to S. V. Forgue, issued Jan. 3, 1961 entitled "Composite Photoconductive Layer" or an optical display device having a target of the type shown in U.S. Pat. No. 2,928,014 to W. R. Aiken et al., issued Mar. 8, 1960 entitled "Electronic Device Cathode Ray Tube". A preferred device is an optical display device and the present invention will be described in detail as embodied in an optical display device. However, the other types of electron beam addressed devices can be constructed similarly to the optical display device by substituting the particular target of the electron beam addressed device for the phosphor screen target of the optical display device.

It has long been a desire to reduce the depth dimension of such electron beam addressed devices, particularly picture tubes, to provide a substantially flat device. With regard to optical display devices, one structure which has been proposed includes a thin box-like envelope with one of the large sides thereof constituting a faceplate on which a phosphor screen is disposed. An electron gun directs electrons across the tube in a path substantially parallel to the screen. Deflection elements are provided to selectively deflect the electrons onto successive points of the screen to achieve the desired scanning thereof. A tube of this type is shown in U.S. Pat. No. 2,928,014 to W. R. Aiken et al., issued Mar. 8, 1960 entitled "Electronic Device Cathode Ray Tubes".

In using this technique a problem has arisen in making flat display devices having large area screens, such as screens which are about 75 centimeters by 100 centimeters. For such large size devices some type of internal support structure is required to prevent the evacuated envelope from collapsing. A device having such internal support is shown in U.S. Pat. No. 2,858,464 to W. L. Roberts, issued Oct. 28, 1958 entitled "Cathode Ray Tube". In a tube having internal support structure, the confinement and guiding of the electron beam is more critical to prevent the supporting structure from interfering with the electron beam.

As a beam of electrons moves away from its source, the electrons tend to spread out, making the size of the beam larger in cross-section. If the electrons spread out enough so that a substantial amount of them contact the supporting structure, parts of the tube become charged and cause malfunctioning of the tube.

SUMMARY OF THE INVENTION

An electron beam addressed device includes an evacuated envelope having closely spaced, substantially parallel front and back walls. A target is disposed along the inner surface of the front wall. Means is provided for generating and directing electrons along a path between said front and back walls substantially parallel to said target. Extending along the entire length of the path of the electrons is means for confining the electrons in a beam and for deflecting the beam toward the target at selected points along the path of the beam.

DETAILED DESCRIPTION

Figure 1:
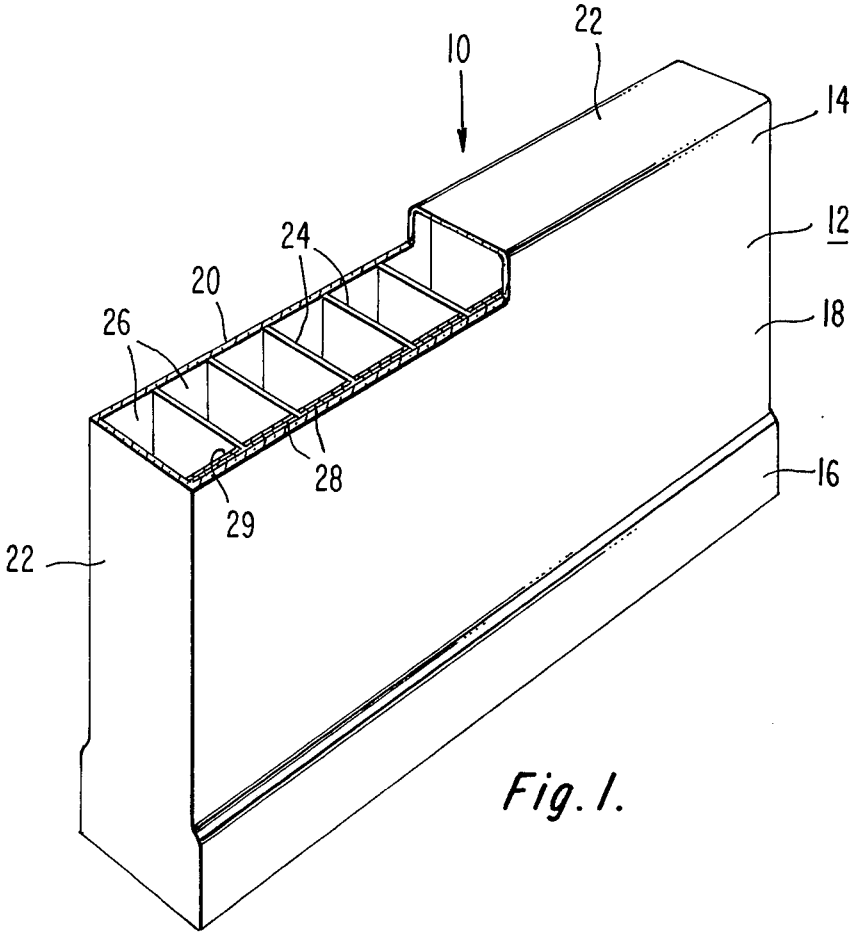
FIG. 1 is a perspective view partially cut-away, of a flat display device according to the present invention.

Referring to FIG. 1, one form of a flat display device of the present invention is generally designated as 10. The display device 10 comprises an evacuated envelope 12, typically of glass, having a display section 14 and an electron gun section 16. The display section 14 includes a rectangular front wall 18, and a rectangular back wall 20 in spaced, parallel relation with the front wall 18. The front wall 18 and back wall 20 are connected by side walls 22. The front wall 18 and back wall 20 are dimensioned to provide the size of the viewing screen desired, e.g., 75 × 100 centimeters and are spaced apart about 2.5 to 7.5 centimeters.

A plurality of spaced, parallel supporting walls 24 are secured between the front wall 18 and the back wall 20 and extend from the gun section 16 to the opposite side wall 22. The supporting walls 24 provide the desired internal support for the evacuated envelope 12 against external atmospheric pressure and divide the display section 14 into a plurality of channels 26. On the inner surface of the front wall 18 is a target, in the form of a phosphor screen 28. The phosphor screen 28 may be of any well-known type presently being used in cathode ray tubes, e.g. black and white or color television display tubes. A metal film electrode 29 is provided on the phosphor screen 28.

The gun section 16 is an extension of the display section 14 and extends along one set of adjacent ends of the channels 26. The gun section may be of any shape suitable to enclose the particular gun structure contained therein.

In each of the channels 26 is a guide for confining electrons directed into the channel in a beam which travels a path spaced from the walls of the channel. The guide also includes means for deflecting the beam toward the phosphor screen 28 at various points along the length of the channel 26.

Figure 2:
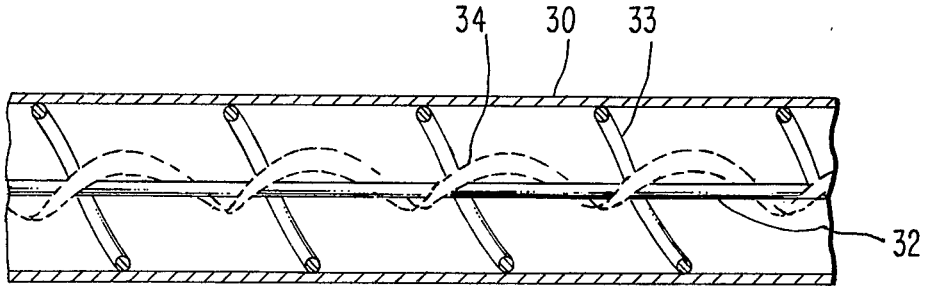
FIG. 2 is a schematic view of one technique for confining an electron beam.

Referring to FIG. 2, there is schematically illustrated one guide structure for confining electrons in a beam which can traverse the length of a channel without undesirably impinging the walls 24. This structure includes an outer conductive tube 30 and a conductive rod 32 extending longitudinally along the axis of the tube 30. By applying a potential to the rod 32 which is positive with respect to the tube 30 electrostatic forces are created between the tube 30 and the rod 32 which will cause electrons injected into the tube to travel in a circular path around the rod 32. If the electrons are injected into the tube 30 at an angle so as to have a component of movement longitudinally along the tube, the electrons will travel in helical paths around and along the rod 32. By placing an electrode, such as a wire or ribbon 33, around and along a spiral path within and insulated from the tube 30 and making the electrode 33 more negative than the tube 30, electrostatic forces are applied to the electrons which maintain the electrons in a restricted helical path. As illustrated in FIG. 2, this provides a beam of electrons 34 which flows in a restricted helical path around and along the rod 32. The helical path of the beam 34 extends bifilarly with respect to the helical path of the electrode 33 and is of the same pitch as that of the electrode 33. Thus, the electron beam 34 will travel along the rod 32 with its spacing from the rod maintained substantially constant.

I have found that the electron beam can be deflected out of its helical path at selected points along the length of the rod 32 by forming the rod 32 of a plurality of aligned segments. By switching the potential applied to any one of the rod segments so that the segment potential is approximately that of the tube 30, the electrons will not be drawn back around the rod segment but will flow away from the rod segment toward the tube 30. By providing openings in the tube 30, the deflected electron beam can pass out of the tube 30. The openings should be spaced along a longitudinal line at points between the positions where the electrode 33 crosses the line. By selecting the pitch of the electrode 33 and hence the number of openings, the number of positions at which the electron beam can be extracted from the tube 30, can be selected.

Referrring to FIGS. 3–6, there is shown one form of a guide, generally designated as 36, utilizing the beam confining and extraction technique described with reference to FIG. 2. The guide 36 comprises a back half portion **38*a* and a mating front half portion 38*b* extending longitudinally along the channel 26. The back half portion 38*a* is adjacent the inner surface of the back wall 20 and, as shown in FIG. 6, is made up of a set of alternating metal plates 40*a* and 41*a***.

Figure 4:
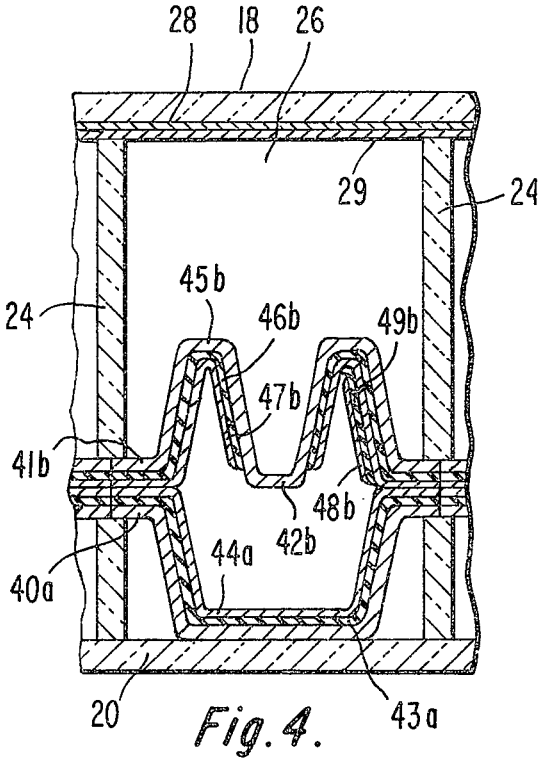
FIG. 4 is a sectional view taken along line 4—4 of FIG. 3.
Figure 6:
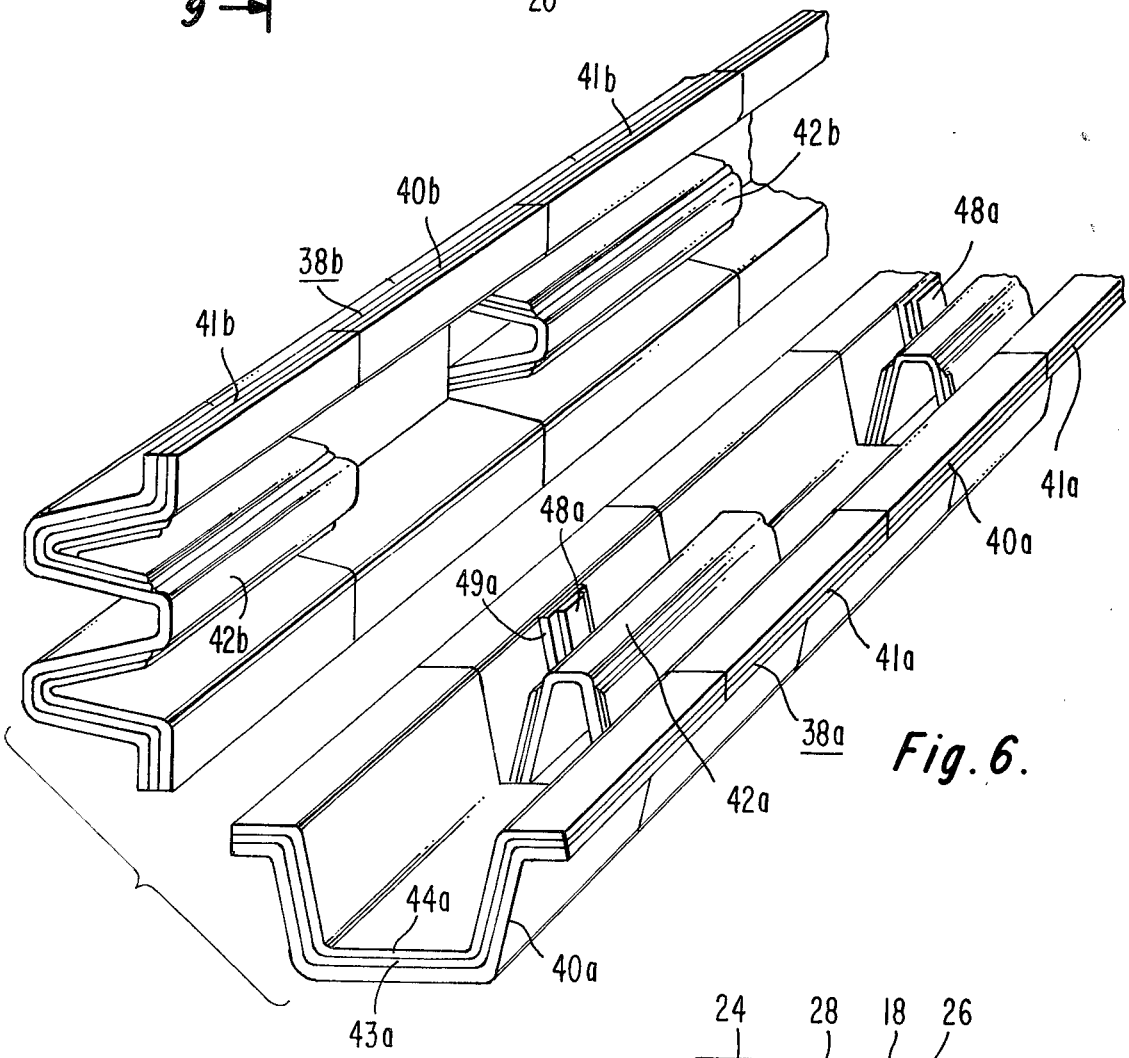
FIG. 6 is an exploded perspective view of a portion of the beam guide illustrated in FIG. 2.

As shown in FIGS. 4 and 6, each of the plates **40*a* is in the form of a substantially U-shaped trough which fits in the channel 26 with the open side of the trough facing away from the back wall 20 of the envelope 12. The open side surface of each of the U-shaped trough plates 40*a* is coated with a layer 43*a* of an insulating material, such as a plastic or an oxide, e.g., silicon oxide or aluminum oxide. A film 44*a* of an electrically conductive metal is coated over the insulating layer 43*a***.

Figure 5:
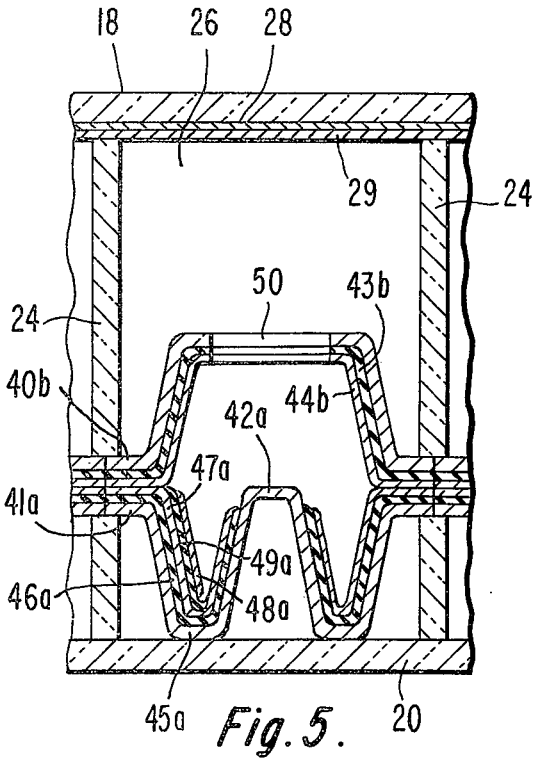
FIG. 5 is a sectional view taken along line 5—5 of FIG. 3.

As shown in FIGS. 5 and 6, each of the plates **41*a* is in the form of a substantially W-shaped trough which fits in the channel 26 with the open side of the trough facing away from the back wall 20 of the envelope 12. A layer 46*a* of an insulating material is coated on the forward facing surface of the W-shaped trough plate 41*a* except for the center tips 42*a* of the W-shaped trough. A film 47*a* of an electrically conductive material, such as a metal, is coated on the insulating layer 46*a*. As shown in FIG. 6, a separate strip 48*a* of an electrically conductive material extends over the forward facing surface of the outer walls of the W-shaped trough and is insulated from the electrically conductive film 47*a* by a second layer 49*a* of an insulating material. Each of the conductive strips 48*a* extends along a section of a continuous helical path. The U-shaped trough plates 40*a* and the W-shaped trough plates 41*a* are arranged in alternating relation along the length of the channels 26 with the U-shaped troughs and the W-shaped troughs being in end-to-end aligned relation along the channel. The U-shaped trough plates 40*a* and the W-shaped trough plates 41*a*** are electrically insulated from each other either by being spaced slightly apart or by having an insulating spacer member between their ends.

The front half portions **38*b* is made up of a set of alternating metal plates 40*b* and 41*b*. As shown in FIG. 5, each of the plates 40*b* is in the form of a substantially U-shaped trough similar to the U-shaped trough of plates 40*a* of the back half portion 38*a*. Each of the U-shaped trough plates 40*b* fits in the channel 26 with the open side of the U-shaped trough facing toward the back wall 20 of the envelope 12. Each of the U-shaped trough plates 40*b* has an opening 50 through the bottom wall thereof. The inward facing surface of each of the U-shaped trough plates 40*b* is coated first with a layer 43*b* of an insulating material and secondly with a film 44*b* of an electrically conductive material. Thus, the U-shaped trough plates 40*b* of the front half portion 38*b* are of the same construction as the U-shaped trough plates 40*a* of the back half portion 38*a* except that the U-shaped trough plates 40*b* have openings in the bottom walls of the troughs. Also, the U-shaped trough plates 40*a* and 40*b*** face in opposite directions.

As illustrated in FIG. 4, each of the plates **41*b* of the front half portion 38*b* is in the form of a substantially W-shaped trough which fits in the channel 26 with the open side of the W-shaped trough facing toward the back wall 20 of the envelope 12. A layer 46*b* of an electrically insulating material is coated on the rearward facing surface of each of the W-shaped trough plates 41***b* except for the center tip 42*b* of the W-shaped trough. A film 47*b* of an electrically conductive material is coated on the insulating layer 46*b*. A separate strip 48*b* of an electrically conductive material extends over the rearward facing surface of the outer walls of the W-shaped trough and is insulated from the electrically conductive film 47*b* by a second layer 49*b* of an insulating material. Each conductive strip 48*b* extends along a segment of a continuous helical path. Thus, the W-shaped trough plate 41*b* of the front half portion 38*b* is of the same construction as the W-shaped trough plate 41*a* of the rear half portion 38*a*. However, the W-shaped trough plates 41*a* and 41*b* face in opposite directions.

The U-shaped trough plates 40*b* and the W-shaped trough plates 41*b* of the front half portion 38*b* are arranged in alternating relation along the length of the channel 26 with the troughs being in end-to-end aligned relation. The U-shaped trough plates 40*a* are electrically insulated from the W-shaped trough plates 41*b* either by being spaced slightly apart or by an insulating spacer between their ends. Each of the U-shaped trough plates 40*b* of the front half portion 38*b* is disposed in facing relationship with and mates with a separate W-shaped trough plate 41*a* of the back half portion 38*a* to form a passage therebetween. Also, the metal film 44*b* on the U-shaped trough plate 40*b* contacts the metal film 47*a* on the W-shaped trough plate 41*a*. Each of the W-shaped trough plates 41*b* of the front half portion 38*b* is disposed in facing relationship with and mates with a U-shaped trough plate 40*a* of the back half portion to form a passage therebetween. Also, the metal film 47*b* on the W-shaped trough plate 41*b* contacts the metal film 44*a* on the U-shaped trough plate 40*a*. In each channel 26, the passages formed by the mating sets of troughs are in alignment to form an undulating passage along the length of the channel. The adjacent corresponding plates of the guides in adjacent channels 26 may be mechanically and/or electrically connected together. For example, corresponding plates for all channels may be provided as a single metal strip formed with a series of U-shaped or W-shaped undulations.

Figure 3:
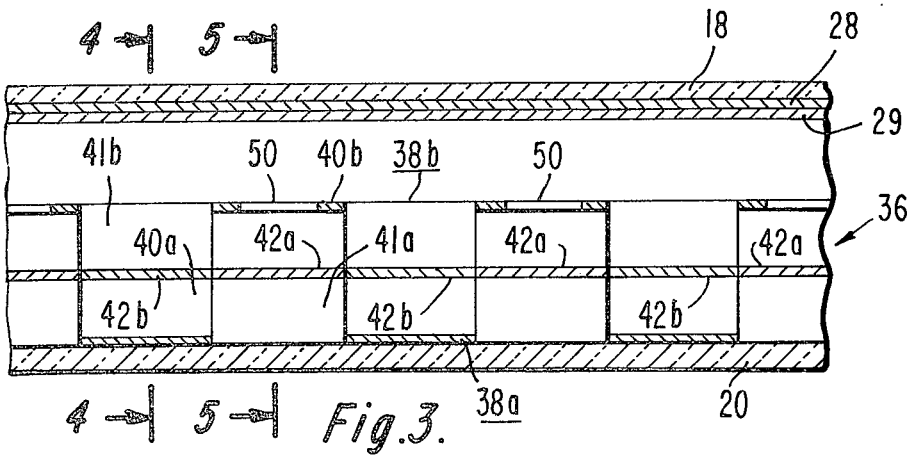
FIG. 3 is a longitudinal sectional view of one form of a beam guide of the present invention using the beam confining technique illustrated in FIG. 2.

In the operation of the guide 36, the metal films 44*a*, 47*a*, 44*b* and 47*b* perform the function of the outer tube 30 of the focussing means illustrated in FIG. 2. The exposed center tips 42*a* and 42*b* of the W-shaped trough plates 41*a* and 41*b*, which, as shown in FIG. 3, are in longitudinal alignment along the length of the channel 26, perform the function of a segmented center rod 32. The metal strips 48*a* and 48*b*, which extend along a helical path, serve the function of the electrode 33. Thus, by applying the appropriate potentials to the plates 41*a* and 41*b* and the metal strips 48*a* and 48*b*, a stream of electrons directed into the end of the passage formed by the mating troughs will be confined into a beam which will flow in a helical path along the length of the passage. Although the passage is an undulating passage, it will accommodate the helical flow of the beam since the helical path is in essence an undulating path with an additional movement transverse to the undulations. If the potential applied to one of the W-shaped trough plates 41*a* of the back half portion 38*a* is switched to a less positive potential, as the electron beam passes over the center tip 42*a* of the W-shaped trough plate 41*a*, it will not be pulled back into its helical orbit but will pass out of the passage through the opening 50 in the adjacent U-shaped trough plate 41*b* of the front half portion 38*b*. The electron beam which passes through the opening 50 in a U-shaped trough plate 41*b* is attracted to the phosphor screen 28 so as to impinge thereon due to a potential difference between the electrode 29 and the means forming the electron beam. If desired, focusing and accelerating electrodes for the electron beam may be provided in the channel 26 between the guide 36 and the phosphor screen 28 to control the size of the beam. Thus, by switching the potential applied to various ones of the W-shaped trough plates 41*a*, the beam can be deflected toward the phosphor screen 28 at various points along the length of the channel 26.

Figure 7:
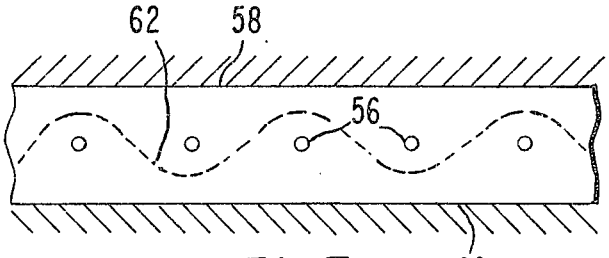
FIG. 7 is a schematic view illustrating another technique for confining an electron beam.

Referring to FIG. 7, there is schematically shown another technique for confining electrons in a beam which travels along the length of a defined path. This technique is known as "slalom focussing" and is described in the article entitled "Slalom Focussing", by J. S. Cook et al., *Proceedings of the IRE*, Vol. 45, Nov. 1957, pgs. 1517–1522. Slalom focussing, as there described, makes use of a plurality of spaced, parallel, positively charged wires or rods 56 arranged in a common plane midway between two parallel, grounded or negatively charged plates 58 and 60. The positive charge on the rods or wires 56 creates an electrostatic field such that when a beam of electrons is directed into the spaces between the plates 56 and 60 along the plane of the rods or wires 56, the beam will weave an undulating path through the array of rods or wires 56 as indicated by the line 62.

Figure 8:
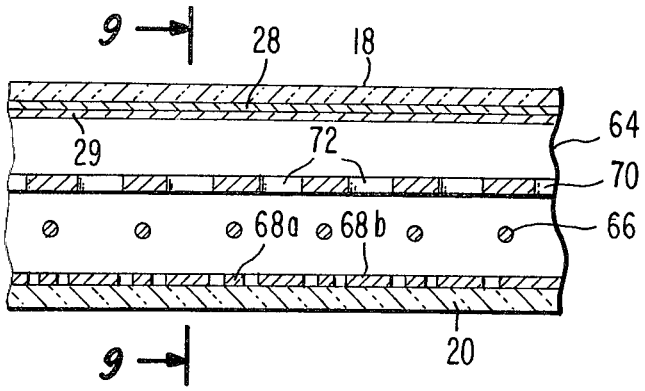
FIG. 8 is a longitudinal sectional view of one form of a beam guide using the confining technique illustrated in FIG. 7.
Figure 9:
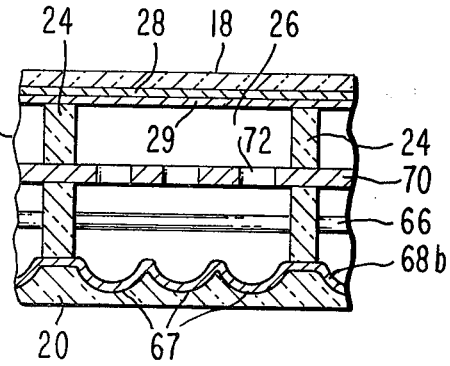
FIG. 9 is a sectional view taken along line 9—9 of FIG. 8.

Referring to FIGS. 8 and 9, there is shown a guide 64 incorporated into the display device 10 of the present invention which utilizes slalom focussing. The guide 64 comprises a plurality of spaced, parallel wires 66 extending traversely across the channels 26 of the envelope 12 with the wires 66 extending through and being supported by the supporting walls 24. The wires 66 are in a common plane adjacent and aparallel to the back wall 20 of the envelope 12. In each of the channels 26 the back wall 20 has three arcuate grooves 67 extending in spaced, parallel relation along the length of the channel. On the inner surface of the back wall 20 are a plurality of spaced, parallel strips 68*a* and 68*b* of an electrically conductive metal. The strips 68*a* and 68*b* extend traversely across all of the channels 26 and across the surface of the grooves 67. The strips are arranged so that there is a separate strip 68*a* behind and coextensive with each of the wires 66 and a separate strip 68*b* coextensive with each of the spaces between the wires 66.

A metal plate 70 extends traversely across and longitudinally along the channels 26 between the wires 66 and the front wall 18 of the envelope 12. The plate 70 is spaced from the wires 66 a distance substantially equal to the spacing between the wires 66 and the metal strips 68*a* and 68*b*. The plate 70 has a plurality of holes 72 therethrough with the holes 72 being arranged in three spaced, parallel rows extending longitudinally along the channels 26 with each row disposed opposite and along a groove 67 in the back wall 20. As shown in FIG. 8, the holes 72 in each row are positioned between the wires 66. The number of grooves 67 in the back wall 20 and the number of rows of holes in each channel 26 depends on the number of beams to be directed along the channel. In the form of the guide shown in FIG. 9, there are three grooves and three rows of holes for three beams.

In the operation of the slalom guide 64, a positive potential is applied to each of the wires 66. The strips 68*a* and 68*b* and plate 70 are connected to ground. Separate electron beams are directed into the channel 26 along each of the grooves 67. Each of the electron beams will follow an undulating path through the array of the wires 66 as previously described with regard to the slalom focussing technique illustrated in FIG. 7. The arcuate shape of the ground plane strips in each of the grooves 67 creates electrostatic forces which are applied to the electron beam and restrict the electrons to the particular undulating path along the grooves. By switching one of the strips 68*a* to a negative potential, an electrostatic force will be applied to the electron beam as it passes between the strip and its adjacent wire 66 to deflect the beam out of the undulating path toward the front wall 18. The beam will pass through an opening 72 in the plate 70 and be attracted to the phosphor screen 28 on the front wall 18 by a potential applied to the electrode 29. Focussing and accelerating electrodes for the electron beam may be provided between the plate 70 and the phosphor screen 28. By switching the potential applied to various ones of the metal strips 68*a*, the electron beam can be deflected out of the guide toward the phosphor screen 28 at various points along the length of the channel 26.

Figure 10:
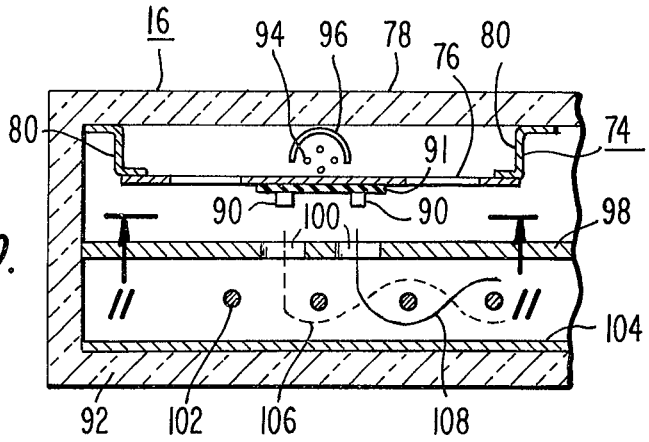
FIG. 10 is a sectional view of the gun section of the display device of the present invention illustrating one form of an electron beam gun.
Figure 11:
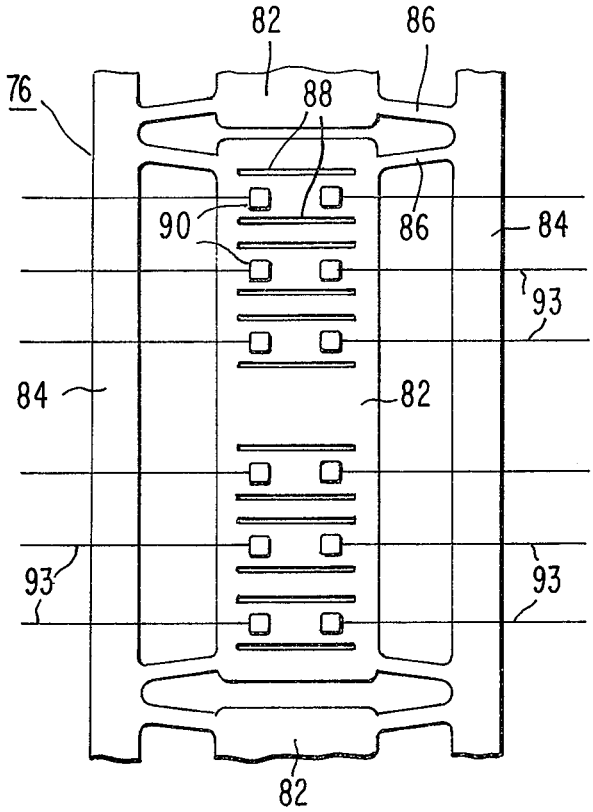
FIG. 11 is a plan view of the beam gun shown in FIG. 10 taken along line 11—11.

The gun section 16 of the display tube 10 contains a gun structure which is capable of generating electrons and directing the electrons into the guides in the channels 26. Referring to FIGS. 10 and 11, one form of an electron gun suitable for this purpose is generally designated as 74. The gun 74 comprises a substrate 76 mounted by a pair of brackets 80 in spaced, parallel relation to a front wall 78 of the gun section 16, which is an extension of the front wall 18 of the display section 14. Thus the substrate 76 extends along one edge of and is parallel to the phosphor screen 38 and extends across the open ends of the channels 26. The substrate 76 is a thin strip of electrically conductive material which is strong and which exhibits low thermal conductivity, such as stainless steel or Kovar. The substrate 76 includes a plurality of substantially rectangular grid sections 82 supported in aligned, end to end spaced relation between a pair of mounting strips 84 by narrow connecting webs 86. This structure of the substrate 76 permits expansion and contraction of the grid sections 82 during the operation of the gun 74. Each of the grid sections 82 has a plurality of spaced, parallel slits 88 therethrough extending parallel to the ends of the grid section.

Cathodes 90 are mounted on the side of the grid sections 82 facing the back wall 92 of the gun section 16 which is an extension of the back wall 20 of the display section 14. The cathodes 90 are mounted between adjacent pairs of the slits 88 and are electrically insulated from the substrate 76 by a layer 91 of electrical insulating material as shown in FIG. 10. The cathodes 90 are of any material which exhibits electron emissivity, such as barium oxide. For purposes hereinafter described, there are two spaced cathodes 90 between each alternate pair of slits 88 and the cathodes 90 are arranged in groups of three pairs. Wires 93 are connected to each of the cathodes 90 to permit a modulating potential to be applied to each cathode.

A heater 94, such as of tungsten wires, extends between the substrate 76 and the front wall 78 of the gun section. The heater 94 is positioned adjacent to the cathodes 90. An arcuate shield 96 extends between the heater 94 and the front wall 78 of the gun section 16 to protect the front wall 78 from the heat of the heater and to reflect the heat toward the cathodes 90.

A metal grid plate 98 extends between the gun 74 and the back wall 92 of the gun section 16. The grid plate 98 has holes 100 therethrough, each of which is in alignment with a separate cathode 90. The gun 74 is adapted for use with a slalom focussing guide of the type shown in FIGS. 8 and 9. Thus, between the grid plate 98 and the front wall 92 of the gun section are a plurality of spaced wires 102 which are disposed in a common plane with the wires 66 of the guide 64 shown in FIG. 8. A metal film ground plane 104 is on the innersurface of the front wall 92 of the gun section 16. The gun 74 extends along the gun section 16 across all of the channels 26 of the display section 14.

In the operation of the gun 74, the heater 94 is energized to heat the cathodes 90 so as to achieve the emission of electrons from the cathodes. The grid sections 82 behind the cathodes 90 are made negative with respect to the grid plate 98 having the holes 100 therethrough. By applying to a cathode 90 a voltage which is slightly positive with respect to the grid section 82 but not as positive as the grid plate 98, the electrons emitted from the cathode 90 will flow toward the grid plate 98 and will pass through the adjacent opening 100 in the grid plate 98. The stream of electrons passing through the opening 100 will enter the electrostatic field created by the potential applied to the wires 102. As previously described with regard to the guide 64 shown in FIGS. 8 and 9, this will cause the electrons to follow an undulating path through the array of the wires and along the beam guide which is in alignment with the particular cathode. The flow of electrons from a cathode 90 can be controlled by varying the voltage applied to the cathode. As the voltage applied to the cathode is made more positive with respect to the grid plate 98 the flow of electrons decreases until the flow is actually cut off.

In the operation of the display tube 10, the cathodes 90 along the entire length of the gun 74 are activated to provide one or more beams of electrons along each of the beam guides 64. When the electron beams reach the top ends of the beam guides 64 the electron beams are deflected to pass out of the beam guides by switching the appropriate metal strip 68*a* (FIG. 8) to a negative potential. The electron beams will then impinge on the phosphor screen 28 to achieve a first line scan of the phosphor screen. By switching the potentials applied to the strip 68*a* in sequence the electron beams are deflected at various points along the beam guides to achieve a sequential line-by-line scanning of the phosphor screen. The electron beams can be modulated by varying the voltage applied to the cathodes 90. Thus, the line-by-line scanning of the phosphor screen 28 at the appropriate speed by the modulated electron beams will provide a picture which can be viewed through the front wall 18 of the display device.

In the form of the gun 74 shown in FIGS. 10 and 11, the cathodes 90 are arranged in pairs. The cathode at the left, as viewed in FIG. 10, will provide a beam of electrons which will flow in an undulating path as indicated by the dash line 106 whereas the cathode at the right will provide a beam of electrons which will flow in an undulating path as indicated by the full line 108. Thus, the beam path 106 undulates in the opposite manner to the beam path 108. This permits each of the electron beams to be deflected at points intermediate the deflection points of the other beam so that each of the electron beams will provide different line scans of the phosphor screen. By turning on one or both of the pairs of cathodes 90 by means of the potential applied to the cathode different numbers and positions of line scans can be achieved. As shown in FIG. 10, the cathodes 90 are grouped in arrangements of three pairs. This provides the three sets of electron beams which can be accommodated in a single channel 26 shown in FIG. 9. For a color display device, each of the sets of beams can be used to activate a different color producing phosphor of the screen 28.

Figure 12:
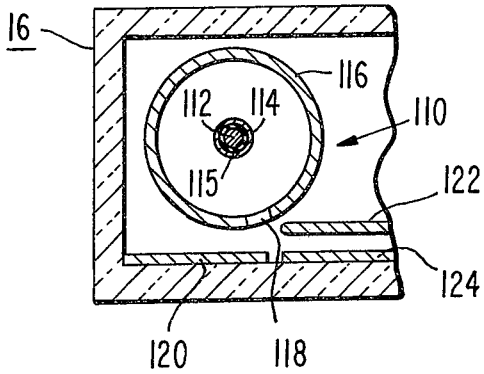
FIG. 12 is a sectional view of the gun section of the display device of the present invention illustrating another form of an electron gun.

Referring to FIG. 12, another form of gun which can be used in the display device 10 of the present invention is generally designated as 110. The gun 110 comprises an elongated heater wire 112 on which is coated the cathode 114. The cathode 114 can be of any well known material which will emit electrons when heated, such as barium oxide. A layer 115 of an electrical insulating material is between the cathode 114 and the heater wire 112. The cathode coated heater wire 112 is mounted in the gun section 16 to extend across the ends of the channels of the display section. Surrounding the cathode coated heater wire 112 is a tubular metal shield 116. The shield 116 has a plurality of holes 118 therethrough with the holes being in spaced longitudinal alignment along the shield. Each of the holes 118 is positioned on a radius of the shield 116 which is angled toward the end of a guide 36 which extends to the gun 110. Each of the holes 118 is adjacent the end of a guide 36. A metal plate 120 is on the back wall 20 of the display tube adjacent the holes 118.

In the operation of the gun 110, an electrical current is passed through the heater wire 112 to heat the cathode 114. This generates electrons within the shield 116. By applying a potential to the shield 116 which is equal to or slightly positive with respect to the cathode 114 and a potential to the plate 120 which is positive with respect to the shield 116 and the cathode 114, the electrons will flow through the holes 118. The electrons flowing through the holes 118 are directed as a stream between spaced parallel plates 122 and 124 which lead the stream into the end of a beam guide in the viewing section 14. The beam guide may be of the type illustrated in FIGS. 3–6 or of the type illustrated in FIGS. 8 and 9. By properly positioning the holes 118, the streams of electrons are directed into the guides at the appropriate angle to cause the electrons to flow as a beam along the guides in the manner as previously described. As previously described, the electron beams can be deflected out of the guides at various points along the guides to achieve a line-by-line scanning of the phosphor screen on the front wall of the display device. The electron beams can be modulated by means of a suitable modulation grid at the holes 118 in the shield 116. The modulation grid may be metal pads on or adjacent to the shield 116 at each of the holes 118 with the pads having holes therethrough aligned with the holes 118. By scanning the phosphor screen at the proper speed and modulating the electron beams a picture is achieved which can be viewed through the front wall of the display device.

Thus, there is provided by the present invention a relatively thin, flat display device which includes internal supports to permit the device to be made in relatively large sizes. The internal supports are arranged to form parallel channels through which electron beams pass. In each of the channels is means for deflecting the electron beam toward a phosphor screen on the front wall on the tube at various points along the channel. Also in each channel is means for confining the electron beam so as to prevent the electrons from spreading out and contacting the walls of the channel. By using the confining means to prevent the electrons from spreading out from the beam it is possible to use relatively low voltages for forming and directing the electron beams into the channels. Also, it permits the use of relatively low voltages for deflecting the beams.

I claim:

1. An electron beam addressed device comprising:

an evacuated envelope having mutually spaced, substantially parallel, front and back walls, a target adjacent to and substantially co-extensive with the front wall, means for generating and directing electrons along at least one path extending between said front and back walls and substantially parallel to said target, guide means disposed along the entire length of said path for creating electrostatic forces which confine the electrons in a beam which is spaced from the walls of the envelope, means for deflecting said beam toward said target at selected points along said path, and openings in said guide means through which the beam can pass when it is deflected toward said target.

2. An electron beam addressed device in accordance with claim 1 in which said target is a phosphor screen extending co-extensive with the inner surface of said front wall.

3. An electron beam addressed device in accordance with claim 2 including means for generating and directing electrons along a plurality of parallel paths extending between said front and back walls and substantially parallel to said front wall, guide means along each of said paths for confining the electrons in a beam which extends along said path and means for deflecting said beams toward said phosphor screen at selected points along said paths.

4. An image display device comprising:

an evacuated envelope having mutually spaced, substantially parallel, front and back walls, and a plurality of spaced, parallel support walls extending between said front and back walls and forming a plurality of parallel channels extending parallel to and between said front and back walls, a phosphor screen adjacent to and substantially co-extensive with the inner surface of said front wall, means at one end of said channel for generating and directing electrons into each of said channels, guide means disposed along substantially the full length of each of said channels for creating electrostatic forces which confine the electrons therein in a beam which is spaced from the walls of the channel and which extends along the channel, said guide means including openings at selected points therealong through which the beam can pass out of the guide toward the phosphor screen, and means for deflecting each of the beams so as to extract it from its guide and direct it toward said phosphor screen at selected points along its respective channel.

5. A display device in accordance with claim 4 in which the envelope includes a substantially rectangular display section and a gun section extending along one edge of the display section, the phosphor screen is on the front wall of the display section, the support walls extend to the gun section so that each of the channels opens into the gun section, and the means for generating the electrons is in the gun section.

6. A display device in accordance with claim 5 in which the means for generating the electrons includes a metal substrate mounted on and extending along a wall of said gun section in spaced relation to said gun section wall, a plurality of spaced cathodes on the surface of the substrate which faces away from said gun section wall, each of said cathodes being electrically insulated from said substrate, and heating means extending between said substrate and said gun section wall.

7. A display device in accordance with claim 6 including a plate extending along the side of the substrate on which the cathodes are mounted in spaced relation to said cathodes, said plate having a plurality of holes therethrough with each of said holes being aligned with a separate one of said cathodes.

8. A display device in accordance with claim 7 in which said substrate comprises a plurality of grid sections mounted in aligned relation between a pair of supporting strips by flexible bands, and the cathodes are on the grid sections.

9. A display device in accordance with claim 8 in which the grid sections have spaced parallel slits therethrough and the cathodes are positioned between the slits.

* * * * *